US006062238A

United States Patent [19]

Korte, Sr. et al.

[11] Patent Number: 6,062,238

[45] Date of Patent: May 16, 2000

[54] METHOD FOR SELF CLEANING OF TOBACCO DRYING APPARATUS

[75] Inventors: Kevin R. Korte, Sr., Macon; Stacey Claire Braxton, Griffin, both of Ga.

[73] Assignee: Brown & Williamson Tobacco Corporation, Louisville, Ky.

[21] Appl. No.: 09/249,533

[22] Filed: Feb. 11, 1999

[51] Int. Cl.[7] ..... B08B 9/02; B08B 7/04

[52] U.S. Cl. ..... 134/22.1; 134/22.11; 134/22.12; 134/22.18; 134/30; 431/2; 432/2

[58] Field of Search ..... 134/19, 22.1, 22.11, 134/22.12, 22.18, 30; 431/2, 500; 432/2

[56] References Cited

U.S. PATENT DOCUMENTS

| | | | |
|---|---|---|---|
| 2,151,264 | 3/1939 | Cavanagh | 432/2 |
| 2,254,980 | 9/1941 | Simmons | 134/22.11 |
| 2,671,741 | 3/1954 | Duvall | 134/22.11 |
| 2,900,285 | 8/1959 | Darmann et al. | 134/22.11 |
| 3,884,249 | 5/1975 | Kelly, Jr. | 134/22.12 |
| 3,888,302 | 6/1975 | Rounds | 165/1 |
| 4,253,821 | 3/1981 | Bradshaw | 432/2 |
| 4,333,773 | 6/1982 | Fjallstrom | 134/22.12 |
| 4,398,961 | 8/1983 | Mason | 134/19 |
| 4,849,026 | 7/1989 | Steinhaus | 134/22.12 |
| 5,101,741 | 4/1992 | Gross et al. | 110/233 |
| 5,297,954 | 3/1994 | Colagiovanni | 431/5 |
| 5,538,420 | 7/1996 | Klobucar et al. | 432/2 |
| 5,651,668 | 7/1997 | Schmid | 431/170 |

*Primary Examiner*—Randy Gulakowski
*Assistant Examiner*—Saeed Chaudhry
*Attorney, Agent, or Firm*—Middleton & Reutlinger; John F. Salazar

[57] ABSTRACT

After several drying cycles in a pneumatically conveying tobacco drying apparatus, the interior of the drying apparatus becomes built-up with tobacco including casings and other additives thereby causing decreased flow of air entrained with tobacco as well as potential contamination with tobacco pieces from previously dried tobacco. Cleaning of the built-up materials is accomplished by recirculating superheated air through the tobacco drying apparatus. The air is heated to a preselected high temperature of at least 430° F. at a rate, generally not to exceed 4° F. per minute and circulated through the drying apparatus for a predetermined period of time. During heating and recirculating air at the preselected temperature, the tobacco materials built up on the drying apparatus are cooked and removed by continual purging with the recirculating air.

8 Claims, 1 Drawing Sheet

METHOD FOR SELF CLEANING OF TOBACCO DRYING APPARATUS

BACKGROUND OF THE INVENTION

1. Field of the Invention

The present invention relates to removal of deposits from the interior of a tobacco drying apparatus. More particularly, the present invention relates to the removal of tobacco deposits in a high humidity drying apparatus with the use of recirculating heated air.

2. Discussion of the Prior Art

In the manufacture of cigarettes and like articles, it is the usual practice to reduce tobacco, the term being used herein to include both lamina and stems, to a particle size appropriate for manufacturing cigarettes. The moisture content of the tobacco is generally increased prior to this size reduction processing in order to minimize tobacco breakup and provide a material of uniform particle size. Furthermore, in order to process the treated tobacco in the manufacturing of cigarette rods, it is necessary to reduce the moisture content of the tobacco to a level below that which the tobacco is at after treatment by casings, flavorings and other high moisture containing additives. The actual drying process has a direct impact upon the quality of tobacco utilized during cigarette manufacturing because of the effect the drying process has upon the tobacco material itself.

Additionally, drying of tobacco after the addition of flavorings and casings has a direct impact upon the quality of the tobacco. If, during drying, the tobacco is subjected to rigorous agitation or contact with stationary surfaces, the tobacco material can be damaged by breakup thus decreasing the filling capacity of the tobacco. This unwanted result is also achieved when drying under low humidity conditions. It is therefore desirable to dry the moist tobacco under high humidity drying conditions.

The high humidity pneumatically conveying drying apparatus used to dry cut tobacco typically requires cleaning due to the interior buildup of deposits of flavorings and other materials added to the tobacco as well as portions of the tobacco material itself. The buildup of material in the dryer is most prevalent in areas where the direction of the pneumatically conveyed tobacco is changed. These 'corners' or 'elbows' usually have the highest incidence of material buildup on their interior surfaces and this buildup can cause hygiene problems as well as reduce the smooth flow of material coming into contact with the built up residue.

Previously, to remove the buildup of material in tobacco dryers, whether they be high humidity dryers or typical in-line dryers, the dryer had to be shut down and cleaned out by flushing with a high volume of hot water or other solution at relatively high pressure. Usually, this cleaning process was performed every 15 to 17 drying operations. Thus, this cleaning had the undesirable effect of lengthy down time for the drying apparatus while the dryer was cleaned. Additionally, if a cleaning solution was used, water had to be flushed through the dryer to remove all traces of the cleaning solution so that subsequently dried tobacco would not be contaminated with the cleaning solution. The excessive cleaning time severely impacts the manufacturing of tobacco products. Moreover, liquid cleaning does not contact all interior drier surfaces.

Prior art attempts to clean interior surfaces and passageways of equipment is shown in U.S. Pat. No. 3,888,302 wherein a heat exchanger for coke ovens and interior passageways therefor require general cleaning on a periodic basis. A reactive material, such as anhydrous hydrochloric acid, is introduced into the passageways to produce reaction products which are volatile when removed in a gas stream and thereby discharged. However, the ability to introduce such reactive material into the present system is extremely restricted due to the necessary requirement of completely removing the reactive material prior to further tobacco processing.

SUMMARY OF THE INVENTION

The present invention is directed to a method for cleaning the interior ducts of a tobacco drying apparatus wherein superheated air is forced through the tobacco dryer at a high airflow flux rate for a short period of time whereby the residue material which has formed on the interior of the dryer is baked off.

More particularly, the present invention comprises a method of cleaning the interior of a pneumatically conveying tobacco drying apparatus utilizing superheated air wherein air is heated indirectly in a furnace and forced through the drying apparatus at a high rate and at an elevated temperature which is sufficient to remove any of the residue which has formed or coated the interior walls of the drying apparatus.

Finally, the present invention is directed to a method of cleaning the interior of a pneumatically conveying tobacco drying apparatus used for drying cut tobacco in order to remove residue material mated onto the interior of said drying apparatus, comprising: recirculating air within the apparatus; heating said recirculated air to from about 430° F. to about 650° F.; maintaining the temperature of said recirculated air at about 650° F. for at least 15 minutes; discontinuing the heating of said recirculated air; and, allowing said drying apparatus to cool.

BRIEF DESCRIPTION OF THE DRAWINGS

A better understanding of the invention will be had upon reference to the following description in conjunction with the accompanying drawings in which like numerals refer to like parts and wherein:

The FIGURE a schematic view of a pneumatically conveying tobacco drying apparatus.

DETAILED DESCRIPTION OF THE PREFERRED EMBODIMENT

Figure 1:
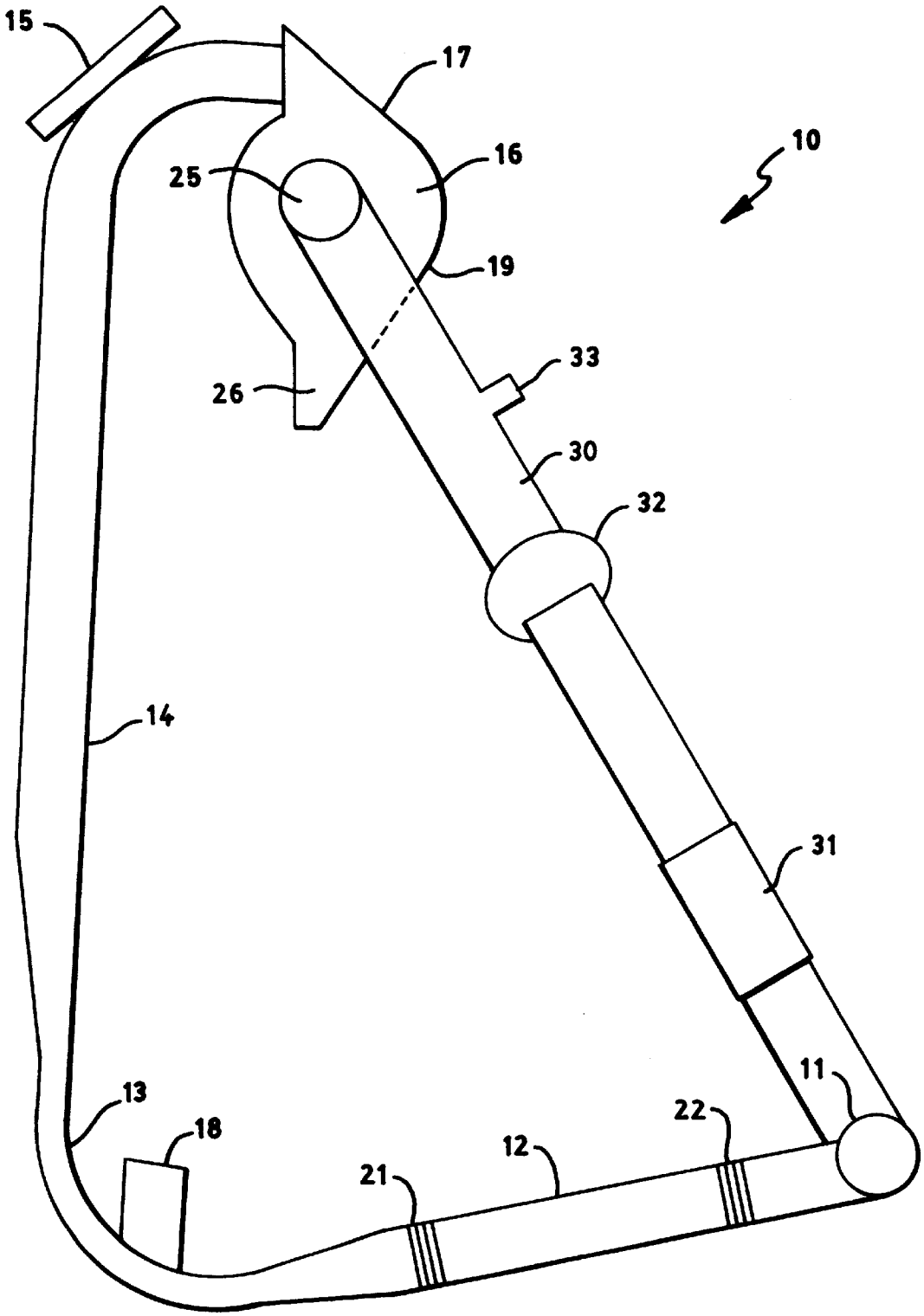

As shown in the FIGURE, a pneumatically conveying high humidity drying apparatus 10 is comprised of multiple duct sections 11, 12, 13, 14, 15, 16 and 30. Air is heated indirectly at a furnace 31. The heated air enters the drying apparatus at entry 11 of furnace exit air duct 12. Expansion joints 21 and 22 are provided in the furnace exit air duct 12 due to the high range of temperatures existent there. Fresh air or make-up air enters the drying apparatus through air return duct 30 and is recirculated through the drying apparatus with blower 32.

Tobacco is added to a high velocity airstream at tobacco inlet 18 and is removed at the tangential separator outlet 26. However, during tobacco drying, fines and small particulates remain in the re-circulating air stream. During drying of the tobacco within the drying apparatus 10, residue buildup is most evident at the elbows 13, 15 and walls 17 and 19 of tangential separator 16. The residue which builds on these surfaces is typically a mixture of casings and tobacco dust as relatively high moisture containing casings are added to the tobacco material prior to drying. Typically, the total moisture of the tobacco upon entry into the drying apparatus 10 is about 20% to 25% by weight and upon exiting is about 13% to 17% by weight. Thus, the air entrained tobacco moving at a high velocity makes the highest incidence of build up with the interior walls of the dryer 10 at elbows 13 and 15 as these elbows cause the greatest change in the flow direction of the tobacco and the entrained tobacco has a relatively high moisture content. Water cooled jackets may be provided in the drying apparatus at elbows 13 and 15 to minimize such contact and prevent such residue buildup. However, over time, tobacco build up forms along the inner walls of the elbows and requires removal.

During the cleaning process, tobacco feed into inlet 18 is discontinued and cooling water to elbows 13, 15 is turned off. The recirculating air is gradually superheated in the furnace and forced through the drying apparatus 10 at a high velocity. The recirculating air is increased in temperature at a rate, preferably not to exceed 4° F. per minute. The recirculating air temperature is increased until a preselected temperature, usually at least 430° F. to about 650° F. is reached. At temperatures exceeding 650° F., cleaning efficiency was not found to be improved. The temperature of the recirculating air is maintained at the preselected temperature for at least 15 minutes. During the heat-up of the recirculating air and the maintaining of the temperature at the preselected temperature, ambient air is added to the drying apparatus at a controlled rate and simultaneously air is purged from the drying apparatus to control the moisture and charred residue in the recirculating air. Typically, a make up air rate of about 25% is required to replenish lost air during the cleaning process. Furnace 31 has a heat exchanger located therein for indirect heating of the recirculated air. Alternatively, direct heating of the circulated air can be accomplished without the use of a heat exchanger by merely passing the air over an open heat source, such as a flame. Also, rotary airlock 26 located at the discharge from tangential separator 16 is closed to recirculate as much air as possible through the exit air duct 25. The superheated air thus requires little additional heating during the cleaning process as it is already at an elevated temperature.

Over a period of generally about 75 minutes, the air is elevated to the preselected temperature. Once the air within the drying apparatus reaches the preselected temperature, the superheated air is forced through the system at a rate of generally about 70,000 to 95,000 lb/hr. The maximum dry air temperature in the tobacco drying apparatus is generally from about 500° F. to about 900° F. with a wet bulb temperature of about 175° F. The furnace then discontinues the indirect heating of the recirculated air and the temperature of the air slowly begins to cool at a rate of approximately 10° F. per minute. The total heating and cooling process time can be as little as 80 minutes or as long as 150 minutes.

At about 350° F. the high temperature cleaning cycle is complete. The drying apparatus is continually cooled down to usually about 180° F. At about 180° F., wash water is run through the apparatus for a preselected period of time, usually about 30 minutes, to remove any loose ash that may still be in the drying apparatus.

The aforementioned cleaning cycle has proven to be extremely effective at removing tobacco deposits inside a high humidity drying apparatus. The cycle completely removes large accumulations of product that normally are removed manually. Additionally, the present cleaning method enables cleaning of areas that are normally inaccessible to manual cleaning or rinsing. Following a cleaning cycle the walls of the drying apparatus are typically covered with a fine dust of ash. After a water wash, the high humidity drying apparatus is free of ash deposits and is ready for normal operation.

The foregoing description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A method of cleaning the interior walls of a tobacco drying apparatus comprising the steps of:

recirculating air within said drying apparatus;

increasing the temperature of said recirculating air at a preselected rate to a preselected drying temperature of from about 430° F. to about 550° F.; and, decreasing the temperature of said recirculating air to about 350° F. or less.

2. The method of claim 1 including the steps of decreasing the temperature of said recirculating air to less than 180° F.; and, washing said drying apparatus with water for a preselected period of time.

3. The method of claim 2, said washing of said drying apparatus with water for a preselected period of time being at least 30 minutes.

4. The method of claim 2, wherein the decreasing of the temperature of said recirculating air to less than 180° F. includes the use of steam.

5. The method of claim 1, including the step of holding said preselected drying temperature for at least 15 minutes.

6. The method of claim 1 wherein said recirculating air is indirectly heated.

7. The method of claim 1 wherein the total cleaning time is between 80 minutes and 150 minutes.

8. The method of claim 1 wherein the tobacco drying apparatus is a high humidity drying apparatus.

* * * * *

UNITED STATES PATENT AND TRADEMARK OFFICE

CERTIFICATE OF CORRECTION

PATENT NO. :6,062,238
DATED : May 16, 2000
INVENTOR(S) : Korte et al

It is certified that error appears in the above-identified patent and that said Letters Patent is hereby corrected as shown below:

Claim 1, col. 4, line 30, change "550°F." to --650°F.--.

Signed and Sealed this

First Day of May, 2001

*Attest:*

Nicholas P. Godici

NICHOLAS P. GODICI

*Attesting Officer*

*Acting Director of the United States Patent and Trademark Office*